US011046407B2

(12) United States Patent
Van Dyke

(10) Patent No.: US 11,046,407 B2
(45) Date of Patent: Jun. 29, 2021

(54) SYSTEM AND METHOD FOR POSITIONING A JACK PLATE COUPLED TO A TRANSOM OF A MARINE VESSEL

(71) Applicant: Brunswick Corporation, Mettawa, IL (US)

(72) Inventor: Christopher J. Van Dyke, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 17 days.

(21) Appl. No.: 16/696,399

(22) Filed: Nov. 26, 2019

(65) Prior Publication Data

US 2021/0155332 A1 May 27, 2021

(51) Int. Cl.
*B63H 20/08* (2006.01)
*B63H 20/06* (2006.01)

(52) U.S. Cl.
CPC ..... *B63H 20/08* (2013.01); *B63H 20/06* (2013.01)

(58) Field of Classification Search
CPC ..... B63H 20/06; B63H 20/08
See application file for complete search history.

(56) References Cited

U.S. PATENT DOCUMENTS

| | | | |
|---|---|---|---|
| 4,757,971 A | 7/1988 | Mapes | |
| 4,842,559 A | 6/1989 | Litjens et al. | |
| 4,861,292 A | 8/1989 | Griffiths et al. | |
| 4,872,857 A | 10/1989 | Newman et al. | |
| 5,352,137 A | 10/1994 | Iwai et al. | |
| 5,647,780 A | 7/1997 | Hosoi | |
| 6,890,227 B1 | 5/2005 | Alby et al. | |
| 9,738,363 B1 * | 8/2017 | Parsley | B63H 1/34 |
| 9,802,688 B1 * | 10/2017 | Tuchscherer | B63H 20/10 |
| 10,281,928 B2 | 5/2019 | Behling et al. | |
| 2020/0108902 A1 * | 4/2020 | Wong | B63H 21/213 |

FOREIGN PATENT DOCUMENTS

JP H0641277 B2 6/1994

OTHER PUBLICATIONS

Seastar Solutions, ProTap Jackplate Controller, http://www.seastarsolutions.com/products/seastar-jackplates/pro-tap-jackplate-controller/, website visited on Nov. 19, 2019.
WIRED2FISH, Hydraulic Jackplate Basics, https://www.youtube.com/watch?v=x7rKI8PrTO4, website visited on Nov. 19, 2019.

* cited by examiner

*Primary Examiner* — Stephen P Avila
(74) *Attorney, Agent, or Firm* — Andrus Intellectual Property Law, LLP

(57) ABSTRACT

A method for positioning a jack plate coupled to a transom of a marine vessel includes: in response to receiving a first store command, storing a measured first position of a movable part of the jack plate in connection with a measured first vessel speed; in response to receiving a second store command, storing a measured second position of the movable part of the jack plate in connection with a measured second vessel speed; in response to determining that the marine vessel is operating at or above the first vessel speed, but below the second vessel speed, automatically positioning the movable part of the jack plate at the stored first position; and in response to determining that the marine vessel is operating at or above the second vessel speed, automatically positioning the movable part of the jack plate at the stored second position.

18 Claims, 6 Drawing Sheets

SYSTEM AND METHOD FOR POSITIONING A JACK PLATE COUPLED TO A TRANSOM OF A MARINE VESSEL

FIELD

The present disclosure relates to systems for coupling marine propulsion devices to transoms of marine vessels. Specifically, the present disclosure relates to systems and methods for vertically positioning a moveable part of a jack plate, which couples a marine propulsion device to a transom of a marine vessel.

BACKGROUND

The following U.S. Patents and Patent Applications are incorporated herein by reference, in their entireties:

U.S. Pat. No. 4,757,971 discloses a mounting assembly for an outboard motor including a motor mount having a transom mounting bracket attachable to a boat transom and a motor supporting bracket spaced aft of and pivotally connected by upper and lower links with the transom mounting bracket to support an outboard motor wholly aft of the boat transom, a cylinder for moving the motor supporting bracket relative to the transom mounting bracket to move the outboard motor between raised and lowered positions, a water sensor for sensing an undesirable seawater level relative to the outboard motor and for generating a signal indicative of the undesirable water level, and an actuator responsive to the undesirable water level signal for actuating the cylinder to raise the outboard motor. An engine speed sensor may also be employed to prevent actuation of the cylinder when the engine speed is above a predetermined speed.

U.S. Pat. No. 4,861,292 discloses a system for optimizing the speed of a boat at a particular throttle setting utilizing sensed speed changes to vary the boat drive unit position vertically and to vary the drive unit trim position. The measurement of boat speed before and after an incremental change in vertical position or trim is used in conjunction with a selected minimum speed change increment to effect subsequent alternate control strategies. Depending on the relative difference in before and after speeds, the system will automatically continue incremental movement of the drive unit in the same direction, hold the drive unit in its present position, or move the drive unit an incremental amount in the opposite direction to its previous position. The alternate control strategies minimize the effects of initial incremental movement in the wrong direction, eliminate excessive position hunting by the system, and minimize drive unit repositioning which has little or no practical effect on speed.

U.S. Pat. No. 4,872,857 discloses a system for optimizing the operation of a marine drive of the type whose position may be varied with respect to the boat by the operation of separate lift and trim/tilt means including an automatic control system which stores preselected drive unit positions for various operating modes and is operative to return the drive unit to any pre-established position by pressing a selected operating mode positioning button. The various operating modes may include cruising, acceleration, trolling and trailering position, any of which may be selectively modified to accommodate changes in both operating or environmental conditions. This system may incorporate other optimization routines and/or automatic engine protection systems to provide virtually complete push button operation for complex marine drive unit positioning mechanisms.

U.S. Pat. No. 6,890,227 discloses a jack plate configured to allow removal of hydraulic components from a fixed portion of the jack plate without having to remove an outboard motor from the jack plate. A mechanical stop device is provided which supports a movable member of the jack plate relative to a stationary member of the jack plate and, as a result, supports the outboard motor even as the hydraulic components are removed from the jack plate. This allows the hydraulic cylinder, hydraulic pump, and motor to be removed from the jack plate by loosening and then detaching a removable bracket member from the jack plate. As a result, the hydraulic system can be inspected, maintained, or replaced without having to remove the outboard motor from the jack plate.

U.S. Pat. No. 10,281,928 discloses a system for a marine vessel operating in a body of water including a trimmable marine device coupled to and movable with respect to the vessel and an actuator that raises and lowers the marine device. A control module is in signal communication with the actuator. A GPS receiver determines a current and/or predicted global position of the vessel, and a processor accesses a memory storing bathymetry data and retrieves a water depth corresponding to the vessel's current and/or predicted global position. The control module compares the water depth to a depth of the marine device based on the marine device's current position. The actuator raises the marine device in response to the control module determining that the water depth is not enough to accommodate the depth of the marine device at the current position without potential collision between the marine device and the body of water's bottom.

SUMMARY

In one embodiment, a method for positioning a jack plate coupled to a transom of a marine vessel and having a part that is vertically movable with respect to the transom by way of an automatic actuator assembly is disclosed. The method is carried out by a controller and comprises: in response to receiving a first store command, storing a measured first position of the movable part of the jack plate in connection with a measured first vessel speed; in response to receiving a second store command, storing a measured second position of the movable part of the jack plate in connection with a measured second vessel speed; in response to determining that the marine vessel is operating at or above the first vessel speed, but below the second vessel speed, controlling the actuator assembly to automatically position the movable part of the jack plate at the stored first position; and in response to determining that the marine vessel is operating at or above the second vessel speed, controlling the actuator assembly to automatically position the movable part of the jack plate at the stored second position.

In one embodiment, a system for positioning a jack plate coupled to a transom of a marine vessel comprises an automatic actuator assembly configured to move a movable part of the jack plate vertically with respect to the transom. A jack plate position sensor is configured to measure a position of the movable part of the jack plate. A vessel speed sensor is configured to measure a speed of the marine vessel. A controller is in signal communication with the jack plate position sensor, the vessel speed sensor, and the actuator assembly. In response to receiving a first store command, the controller stores a measured first position of the movable part of the jack plate in connection with a measured first vessel speed. In response to receiving a second store command, the controller stores a measured second position of the movable part of the jack plate in connection with a measured second vessel speed. In response to determining that the marine vessel is operating at or above the first vessel speed, but below the second vessel speed, the controller controls the actuator assembly to automatically position the movable part of the jack plate at the stored first position. In response to determining that the marine vessel is operating at or above the second vessel speed, the controller controls the actuator assembly to automatically position the movable part of the jack plate at the stored second position.

Various other features, objects, and advantages of the invention will be made apparent from the following description taken together with the drawings.

BRIEF DESCRIPTION OF DRAWINGS

The present disclosure is described with reference to the following Figures.

DETAILED DESCRIPTION

Figure 1:
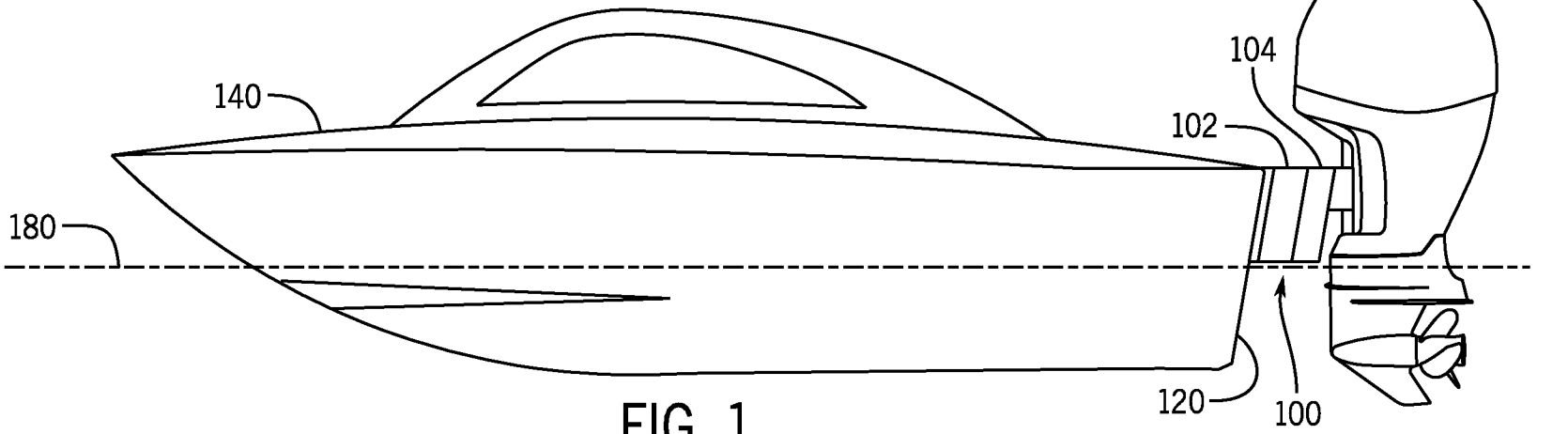
FIG. 1 illustrates a marine vessel with a marine propulsion device coupled to a jack plate in a first position.
Figure 2:
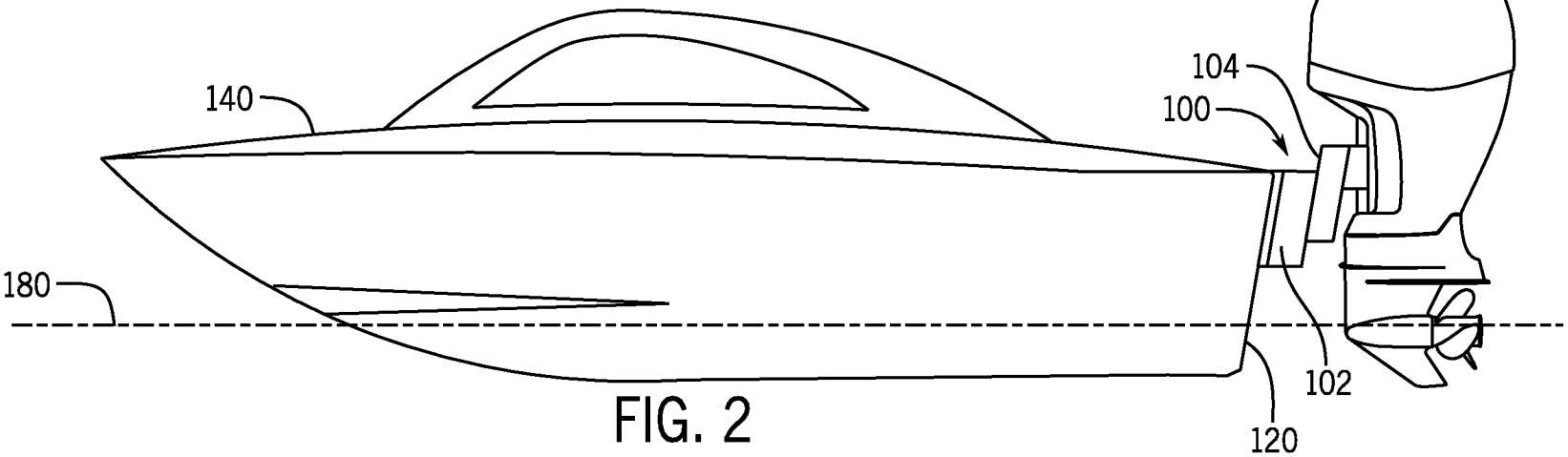
FIG. 2 illustrates the marine vessel with the marine propulsion device coupled to the jack plate in a second position.

Referring to FIGS. 1 and 2, those skilled in the art are familiar with how a jack plate 100 can be attached to a transom 120 of a marine vessel 140 to support a marine propulsion device 160 (such as the outboard motor shown here) in such a way that the marine propulsion device 160 can be raised (FIG. 2) or lowered (FIG. 1) relative to the transom 120. Some jacks plates are manually raised and lowered, while other jack plates are equipped with automatic actuators that assist the operator of the marine vessel 140 in raising and lowering the marine propulsion device 160 by causing a movable part of the jack plate 100, to which the marine propulsion device is attached, to move relative to a stationary part of the jack plate 100, which is attached to the transom 120 of the marine vessel 140. Raising the marine propulsion device 160 allows the marine vessel 140 to get up on plane in shallower water than allowed by a standard, fixed mount; enables the thrust of the marine propulsion device 160 to be directed parallel to the surface of the water 180, thereby increasing fuel efficiency; and provides for better hole shot.

Figure 3:
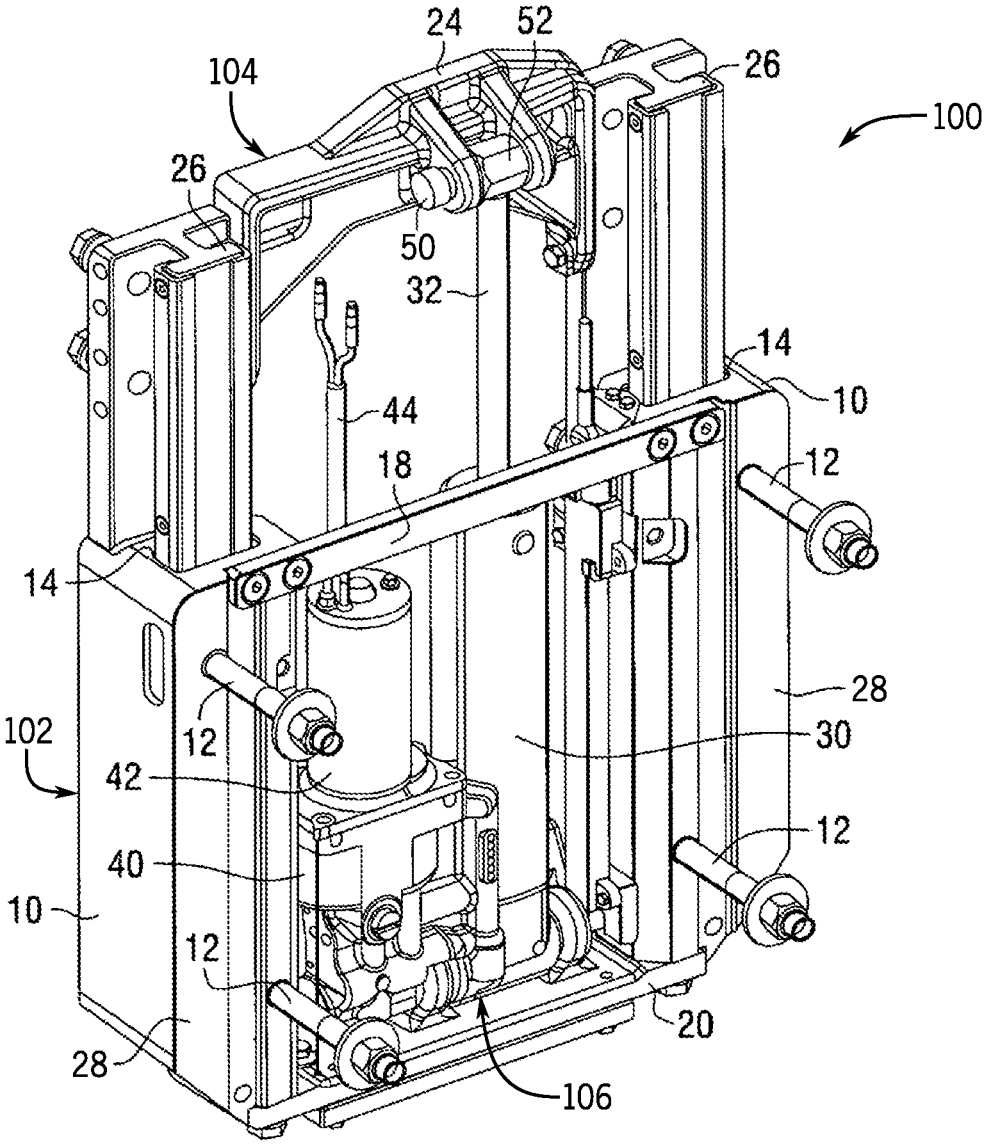
FIG. 3 illustrates a detailed view of the jack plate in the second position.
Figure 4:
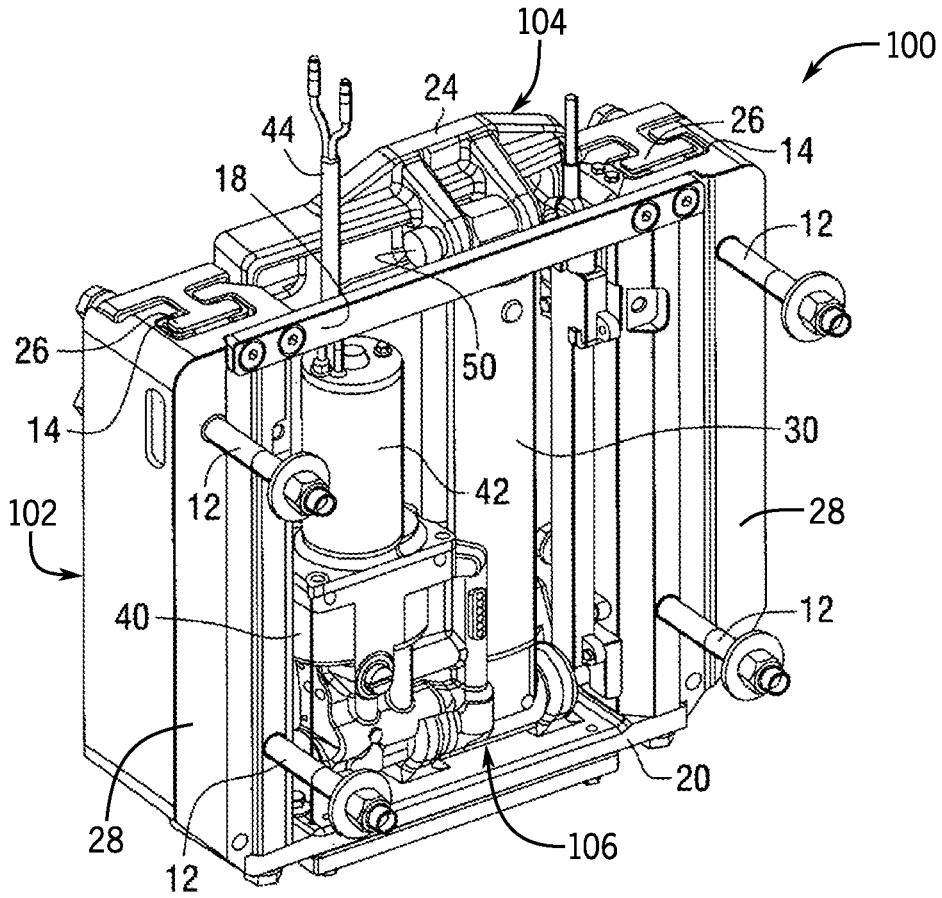
FIG. 4 illustrates a detailed view of the jack plate in the first position.

FIGS. 3 and 4 illustrate one example of a jack plate 100, which includes a first part 10 having two vertical columnar members that are attachable, by bolts 12, to a transom of a marine vessel. The first part 10 is shaped to provide two a C-shaped tracks 14. The two columnar members of the first part 10 are connected together by a bar 18 and a bracket member 20.

A second part 24 of the jack plate 100 is formed to provide two I-shaped members 26 that are respectively slidably contained within the C-shaped tracks 14. This relationship allows the second part 24 to slide vertically relative to the first part 10 while being guided by the relationship between the I-shaped members 26 and the C-shaped tracks 14. A hydraulic cylinder 30, having a piston rod 32 disposed at least partially therein, is attached between the first and second parts, 10 and 24. As a result of this relationship, movement of the piston rod 32 relative to the hydraulic cylinder 30 causes the second part 24 to move relative to the first part 10.

More specifically, the hydraulic cylinder 30 is attached to the bracket member 20. A hydraulic pump 40 and a motor 42 are also attached to the bracket member 20. The motor 42 is provided with electrical power, through conductor 44, and drives the hydraulic pump 40, which pressurizes hydraulic fluid for use in the hydraulic cylinder 30. As a result, the piston rod 32 can be forced upward and extended away from the hydraulic cylinder 30. A pin 50 can be extended through holes in the second part 24, as illustrated, and also through a hole in the small end 52 of the piston rod 32. When connected in this way, extension of the piston rod 32 from the hydraulic cylinder 30 causes the second part 24 to move upward and away from the bracket member 20 which, during operation, is rigidly attached to the bottom ends of the two columnar members of the first part 10.

The first part 10 is attachable to a transom 120 of a marine vessel 140 by way of bolts 12, with the surfaces 28 shown placed in contact with a surface of the transom 120. A marine propulsion device 160 is attachable to the second part 24. Actuation of the hydraulic cylinder 30 therefore can raise the marine propulsion device 160 by raising the second part 24 relative to the first part 10, which is attached to the marine vessel 140.

In FIG. 3, the second part 24 is shown partially raised in an upward direction away from the first part 10 as a result of the piston rod 32 being extended from the hydraulic cylinder 30. It can be seen that the hydraulic cylinder 30 and piston rod 32 are connected between the first part 10 and the second part 24. This allows extension of the piston rod 32 from the hydraulic cylinder 30 to exert a separating force between the first and second parts, 10 and 24, which pushes the second part 24 upward as shown.

FIG. 4 is similar to FIG. 3, but with the second part 24 retracted downwardly into the space defined by the first part 10. This is accomplished by retracting the piston rod 32 into the hydraulic cylinder 30.

Thus, the jack plate 100 can be coupled to a transom 120 of a marine vessel 140 and has a part 104 that is vertically movable with respect to the transom 120 by way of an automatic actuator assembly 106, including motor 42, hydraulic pump 40, hydraulic cylinder 30 and piston rod 32. More specifically, as described herein above, the bolts 12 are used to attach the jack plate 100 to the transom 120 of the marine vessel 140. This attachment retains a stationary part 102 of the jack plate 100 at a specific location relative to the transom 120 of the marine vessel 140 while allowing the movable part 104 to move vertically upwardly or downwardly, as constrained by the relationship between the I-shaped members 26 of the second part 24 and the C-shaped tracks 14 of the first part 10.

The jack plate 100 of FIGS. 3 and 4 is illustrated merely for exemplary purposes. Those having ordinary skill in the art would understand that the jack plate 100 could have many different forms, including that of a parallelogram linkage as disclosed in U.S. Pat. Nos. 4,757,971 or 4,861, 292, which were incorporated by reference herein above. In other examples, the jack plate may not have the entire automatic actuator assembly 106 situated on the jack plate 100, but may instead have the motor 42 and hydraulic pump 40 located on the marine vessel 140 (see FIG. 5) and the hydraulic cylinder 30 and piston rod 32 on the jack plate 100. In still other examples, the automatic actuator assembly may not be hydraulically actuated, but instead may be electrically or pneumatically actuated.

Figure 5:
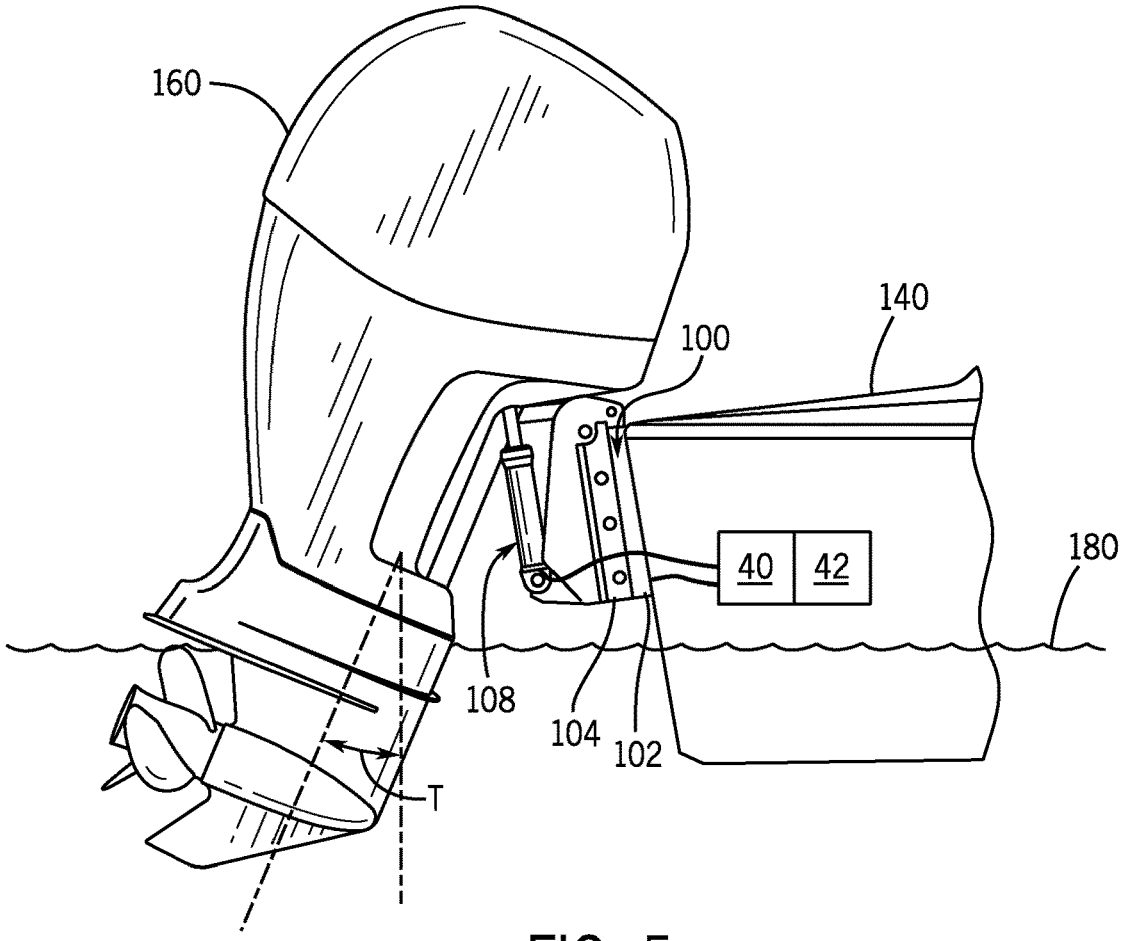
FIG. 5 illustrates a close-up view of the marine propulsion device on the transom of the marine vessel.

Referring to FIG. 5, those skilled in the art of marine vessel propulsion and control are also familiar with many different ways in which the trim angle T of a trimmable marine propulsion device 160 can be manipulated to change the operating characteristics of the marine vessel 140. For example, manual trim control systems are known to those skilled in the art. In typical operation, the operator of a marine vessel 140 can change the trim angle of the associated marine propulsion device 160 as the velocity of the marine vessel 140 changes. This is done to maintain an appropriate angle of the marine vessel 140 with respect to the water 180 as it achieves a planing speed and as it increases its velocity over the water 180 while on plane. The operator inputs a command to change the trim angle, for example by using a keypad, button, or similar input device with "trim up" and "trim down" input choices, which activates a trim actuator 108, such as the piston-cylinder shown here, to raise and lower the marine propulsion device 160. The operator can select these input choices to trim the marine propulsion device 160 up or down until a desired handling or feel of the marine vessel 140 over the water 180 is achieved.

The system of the present disclosure is also capable of carrying out automatic trim (auto-trim) methods, in which the piston rod of the trim actuator 108 is automatically extended or retracted with respect to its current positions in order to rotate the trimmable marine propulsion device 160 and thereby achieve a desired attitude of the marine vessel 140 with respect to vessel speed or engine speed. Auto-trim systems perform the trim operation automatically, as a direct function of vessel speed or engine speed, without requiring intervention by the operator of the marine vessel 140. The automatic change in trim angle of the marine propulsion device 160 enhances the operation of the marine vessel 140 as it achieves planing speed and as it further increases its velocity over the water 180 while on-plane.

Figure 7:
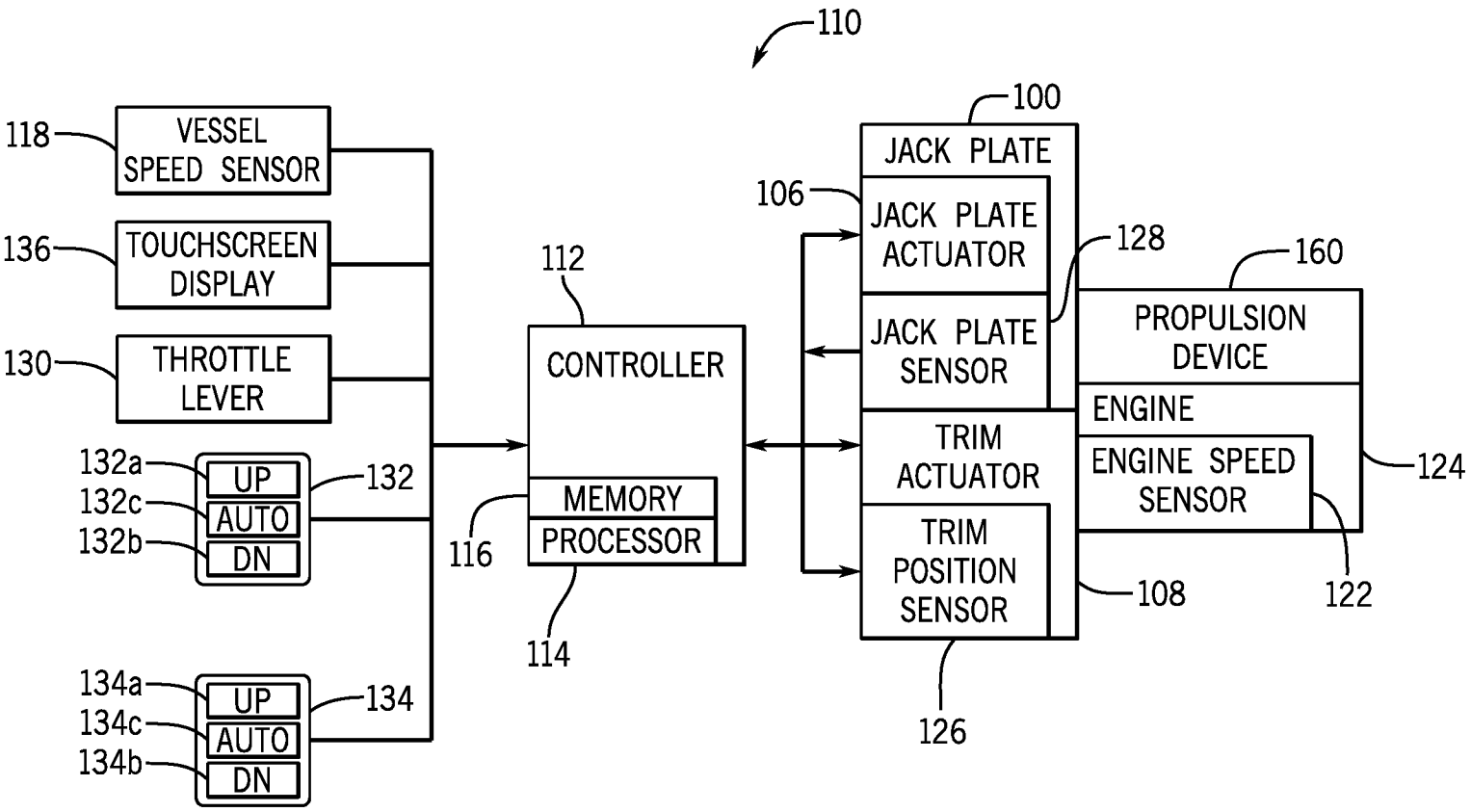
FIG. 7 is a schematic showing a control system of the present disclosure.

FIG. 7 shows an example schematic of a control system 110 for use with the devices shown and described with respect to FIGS. 1-5, which control system 110 carries out the methods described herein. Although the specific devices and connections between the devices shown in the control system 110 resemble those for a marine vessel equipped with one marine propulsion device 160, it should be understood that the marine vessel 140 could have two or more marine propulsion devices, and the same principles described herein would apply.

In one example, the control system 110 includes a controller 112, which is programmable and includes a processor 114 and a memory 116. The controller 112 can be located anywhere in the control system 110 and/or located remote from the control system 110 and can communicate with various components of the marine vessel 140 via a peripheral interface and wired and/or wireless links, as will be explained further herein below. Although FIG. 7 shows one controller 112, the control system 110 can include more than one controller. Portions of the methods disclosed herein can be carried out by a single controller 112 or by several separate controllers. For example, the system 110 can have controllers located at or near a helm of the marine vessel 140 and can also have controller(s) located at or near the marine propulsion device(s) 160. If more than one controller is provided, each can control operation of a specific device or sub-system on the marine vessel 140.

In some examples, the controller 112 may include a computing system that includes a processing system, storage system, software, and input/output (I/O) interfaces for communicating with peripheral devices. The systems may be implemented in hardware and/or software that carries out a programmed set of instructions. For example, the processing system loads and executes software from the storage system, such as software programmed with a trim-position control method and/or jack-plate-position control method, which directs the processing system to operate as described herein below in further detail. The computing system may include one or more processors (e.g., processor 114), which may be communicatively connected. The processing system can comprise a microprocessor, including a control unit and a processing unit, and other circuitry, such as semiconductor hardware logic, that retrieves and executes software from the storage system. The processing system can be implemented within a single processing device but can also be distributed across multiple processing devices or sub-systems that cooperate according to existing program instructions. The processing system can include one or many software modules comprising sets of computer executable instructions for carrying out various functions as described herein.

The controller 112 may itself be, may be part of, or may include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). The controller may include memory (shared, dedicated, or group) that stores code executed by the processing system. In one example, the controller is an engine control module, commonly known to those having ordinary skill in the art The storage system (e.g., memory 116) can comprise any storage media readable by the processing system and capable of storing software. The storage system can include volatile and non-volatile, removable and non-removable media implemented in any method or technology for storage of information, such as computer-readable instructions, data structures, software program modules, or other data. The storage system can be implemented as a single storage device or across multiple storage devices or sub-systems. The storage system can include additional elements, such as a memory controller capable of communicating with the processing system. Non-limiting examples of storage media include random access memory, read-only memory, magnetic discs, optical discs, flash memory, virtual and non-virtual memory, various types of magnetic storage devices, or any other medium which can be used to store the desired information and that may be accessed by an instruction execution system. The storage media can be a transitory storage media or a non-transitory storage media such as a non-transitory tangible computer readable medium.

The controller 112 communicates with one or more components of the control system 110 via the I/O interfaces and a communication link, which can be a wired or wireless link. The controller 112 is capable of monitoring and controlling one or more operational characteristics of the control system 110 and its various subsystems by sending and receiving control signals via the communication link. In one example, the communication link is a controller area network (CAN) bus, but other types of links could be used. It should be noted that the extent of connections of the communication link shown herein is for schematic purposes only, and the communication link in fact provides communication between the controller 112 and each of the peripheral devices noted herein, although not every connection is shown in the drawing for purposes of clarity.

As mentioned, the controller 112 receives inputs from several different sensors and/or input devices aboard or coupled to the marine vessel 140. For example, the controller 112 receives an input from a vessel speed sensor 118, such as for example a pitot tube sensor, a paddle wheel type sensor, or a GPS receiver from which vessel speed can be measured by determining how far the vessel 140 has traveled in a given amount of time. The marine propulsion device 160 is provided with an engine speed sensor 122, such as but not limited to a tachometer, that determines a speed of the engine 124 powering the marine propulsion device 160 in rotations per minute (RPM). A trim position sensor 126 is also provided for sensing an actual position of trim actuator 108, for example, by measuring a relative position between two parts (e.g., the piston rod and cylinder) associated with the trim actuator 108 or by measuring a rotational position of a movable part of the marine propulsion device 160 (such as a swivel bracket) with respect to a stationary part (such as a transom bracket). The trim position sensor 126 may be any type of sensor known to those having ordinary skill in the art, for example a Hall Effect sensor or a potentiometer. The jack plate 100 is moved up and down by the automatic actuator assembly 106, such as the hydraulic piston/cylinder combination described herein above or any other automatic actuator such as an electric, pneumatic, or other type of actuator, which is also in signal communication with the controller 112. A position of the jack plate 100 is determined by a jack plate position sensor 128, which provides such information to the controller 112. The jack plate position sensor 128 can be a Hall Effect sensor or a potentiometer and can determine the relative position of the piston rod 32 with respect the hydraulic cylinder 30 or the vertical position of the movable part 104 of the jack plate 100 with respect to the stationary part 102 of the jack plate 100.

Other inputs to the controller 112 can come from operator input devices such as a throttle lever 130, keypads 132, 134, or a touchscreen display 136. The throttle lever 130 allows the operator of the marine vessel 140 to choose to operate the marine vessel 140 in neutral, forward, or reverse, and at a desired speed, as is known. The keypads 132, 134 can be used to initiate or exit any number of control or operational modes (such as an auto-trim mode or an auto-jack mode, described herein below), or to make selections while operating within one of the selected modes. In one example, the keypad 132 is a trim keypad with an interface having at least a "trim up" input 132*a*, a "trim down" input 132*b*, and an "auto-trim on/resume" input 132*c*, shown herein as buttons. In one example, the keypad 134 is a jack plate keypad with an interface having at least a "jack up" input 134*a*, a "jack down" input 134*b*, and an "auto-jack on/resume" input 134*c*, shown herein as buttons. The controller 112 operates the control system 110 in a manual trim mode in response to selection of one of the "trim up" input 132*a* and "trim down" input 132*b*, and/or in a manual jack plate mode in response to selection of one of the "jack up" input 134*a* or the "jack down" input 134*b*. On the other hand, the controller 112 may operate the control system 110 in an automatic trim mode in response to selection of the "auto-trim on/resume" input 132*c* and/or in an automatic jack plate mode in response to selection of the "auto-jack on/resume" input 134*c*. The touchscreen display 136 can additionally or alternatively be used to initiate or exit any number of control or operational modes (such as trim-up, trim-down, or auto-trim mode and/or jack-up, jack-down, or auto-jack mode), and in that case the inputs can be buttons in the traditional sense or selectable screen icons ("soft" buttons). It should be understood that other operator input devices could be used to trim and/or jack the marine propulsion device 160, such as levers situated on either side of the operator's steering wheel. Additionally or alternatively, the options and modes described herein above can be selected by way of a traditional keyboard, voice command, and/or a wireless or wired remote control device. In some instances, the display is not a touchscreen display, in which case it should be understood that buttons, keypads, levers, keyboards, voice commands, and/or remote control devices could be used to make selections.

Through research and development, the present inventor realized that raising and lowering the height of the marine propulsion device 160 can improve vessel performance when done properly; however, this is difficult to do when various factors affect the position of the marine vessel, for example, external conditions such as vessel load and auto-trimming of the marine propulsion device 160. If the marine propulsion device 160 is not set at the correct height for a given operating condition (such as vessel speed), vessel performance will be less than optimal. For instance, if the vertical positon of the marine propulsion device 160 is too low, the marine vessel 140 will not achieve maximum speed. If the vertical position of the marine propulsion device 160 is too high, the marine vessel 140 will not accelerate properly. Thus, the present inventor realized that vessel-speed-based automatic positioning of the jack plate 100 would allow for changing the height of the marine propulsion device 160 automatically to achieve optimal performance, such as during acceleration and when operating at top speed.

Thus, the present disclosure is of a system 110 for automatically positioning a jack plate 100 coupled to a transom 120 of a marine vessel 140 based on vessel speed. A marine propulsion device 160 is coupled to a movable part 104 of the jack plate 100. The system 110 comprises an automatic actuator assembly 106 configured to move the movable part 104 of the jack plate 100 vertically with respect to the transom 120, so as to raise and lower the marine propulsion device 160 with respect to the surface of the water 180. The system 110 also includes a jack plate position sensor 128 configured to measure a position of the movable part 104 of the jack plate 100, as described herein above. The system 110 also includes a vessel speed sensor 118 configured to measure a speed of the marine vessel 140. The system 110 includes a controller 112 in signal communication with the jack plate position sensor 128, the vessel speed sensor 118, and the automatic actuator assembly 106. An operator interface, such as touchscreen display 136, keypad 134, or other levers, buttons, switches, and/or gauges, is in signal communication with the controller 112.

Figure 8:
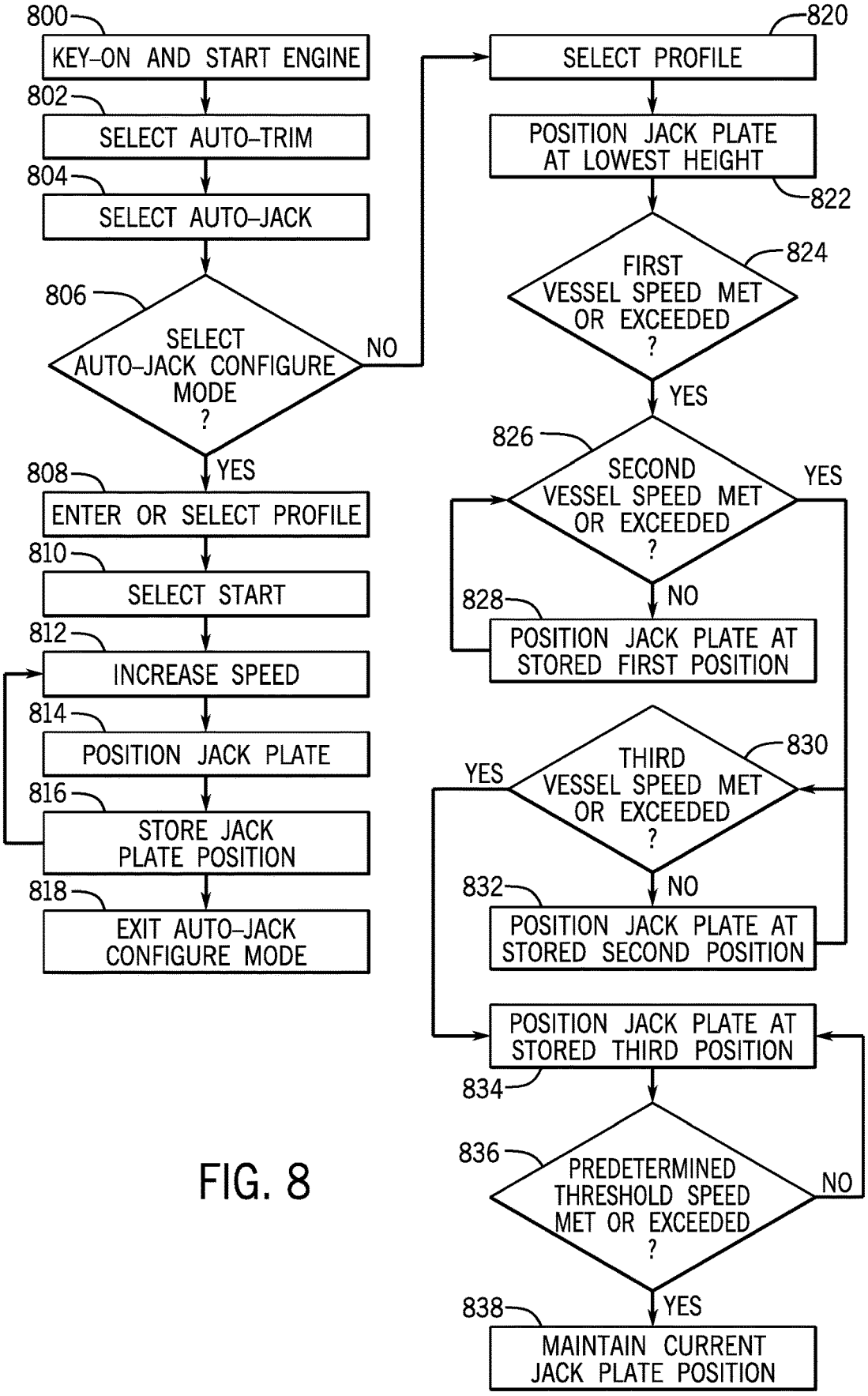
FIG. 8 illustrates a method for positioning a jack plate coupled to a transom of a marine vessel according to the present disclosure.

Referring to FIG. 8, a method for positioning a jack plate 100 coupled to a transom 120 of a marine vessel 140 and having a part 104 that is vertically movable with respect to the transom 120 by way of an automatic actuator assembly 106 is described. The method is carried out by a controller 112 and comprises the following steps, which may be executed in any logical order, the order described herein below being only one example. To begin, the system 110 is keyed "on" at 800, such as by turning a key at the operator's console. Before or after continuing, the operator starts the engine 124 (also shown at 800), such as by pressing an "engine start/stop" button at the helm. The operator may then select auto-trim mode if desired, as shown at 802, such as by pressing the auto-trim on/resume input 132*c* on the keypad 132 or making a similar selection via the touchscreen display 136. Whether auto-trim is selected or not, the operator can then proceed to configure the auto-jack positioning feature.

To begin configuring the auto-jack feature, the operator may select the auto-jack "on/resume" input 134*c*, such as via the keypad 134, or may make a similar selection via the touchscreen display 136, as shown at 804. The operator may then be required to select a "configure" mode for the auto-jack feature, as shown at 806. Optionally, the method includes entering the automatic jack plate positioning mode before or after entering the configuration mode. Optionally, the operator may select to enter the auto-jack configuration mode without selecting the auto-jack on/resume input at all. Optionally, if this is the first time the auto-jack on/resume selection has been made, the system 110 may automatically enter the configuration mode.

Optionally, as shown at 808, the controller 112 may generate a prompt via the operator interface (such as via the touchscreen display 136 or another gauge) for the operator to select or enter a profile name before or after entering the configuration mode. Having different profiles available in the auto-jack mode will provide the operator with more than one choice for speed-based jack plate positioning during operation, as will be described in more detail below.

Optionally, before the auto-jack feature can be further configured, the operator may be prompted or otherwise required to select "start" via the operator interface, such as the touchscreen display 136, as shown at 810. Whether selection of "start" is required or not, the operator next moves the throttle lever 130 to increase speed, as shown at 812. If the engine 124 has not yet been started, the operator will need to start the engine 124 before moving the throttle lever 130. The system 110 may prompt the operator to start the engine 124, or may simply not allow the configuration mode to proceed unless the engine 124 is started. The controller 112 optionally may be programmed to generate a first prompt for the operator to operate the marine vessel 140 at a first vessel speed, such as by displaying a prompt to the operator to increase speed generally or to increase speed specifically to a first predetermined speed value. Alternatively, the operator may increase vessel speed to any first speed he or she desires without first being prompted to do so. While the vessel increases speed, or once the first predetermined or operator-selected speed is reached, the operator adjusts the position of the movable part 104 of the jack plate 100, as shown at 814, until the marine propulsion device 160 is at a desired position with respect to the transom 120. To do so, the operator uses the jack-up and jack-down inputs 134*a* and 134*b*.

Once the operator has positioned the marine propulsion device 160 at a desirable level with respect to the transom 120 as shown at 814, the operator makes a selection to store the position of the movable part 104 of the jack plate 100, as shown at 816. To do so, the operator may enter a first store command via the operator interface, such as a "store" soft key on the touchscreen display 136, or by pressing a button or sequence of buttons on the keypad 134 or another lever. In response to receiving the first store command, the controller 112 stores a measured first position of the movable part 104 of the jack plate 100, as determined by the jack plate position sensor 128, in connection with a measured first vessel speed, determined by the vessel speed sensor 118, at which the marine vessel 140 is operating when the first store command is received. For example, the controller 112 stores the first position of the movable part 104 of the jack plate 100 in connection with the measured vessel speed at the time the store command is received in the memory 116 in a look-up table or other input-output map or chart. The operator may or may not be prompted to enter the first store command. In one example, if the operator is prompted to increase vessel speed to a predetermined speed, once the controller 112 determines that the marine vessel 1404 has reached the predetermined speed using information from the vessel speed sensor 118, the controller 112 generates the "store" prompt.

As shown by the arrow from 816 back to 812, the operator continues to configure the auto-jack feature while increasing vessel speed using the throttle lever 130. For example, while in the configuration mode, the controller 112 may generate a second prompt for the operator to operate the marine vessel 140 at a second vessel speed. Again, the controller 112 may display a prompt to the operator to increase speed generally or to increase speed specifically to a second predetermined speed value. While increasing speed or after increasing speed, the operator determines if the jack plate 100 needs to be re-positioned to achieve desired vessel performance, and positions (or chooses to maintain the position of) the jack plate 100 as appropriate, using the jack-up and jack-down inputs 134*a*, 134*b* as noted herein above. Upon reaching the second predetermined speed, or after sensing that vessel speed has increased, the controller 112 may generate a prompt for the operator to enter a second store command to store a second position of the movable part 104 of the jack plate 100. Optionally, no prompt is provided to increase vessel speed and/or store jack plate position, and the operator simply increases vessel speed to any desired speed, positions the jack plate 100 as desired, and selects to store the jack plate position in connection with the current vessel speed. In response to receiving the second store command, the controller 112 stores a measured second position of the movable part 104 of the jack plate 100, as determined by the jack plate position sensor 128, in connection with the measured second vessel speed, as determined by the vessel speed sensor 118 at the time the store command is received.

The operator may continue to increase vessel speed, re-position the jack plate's movable part 104, and store the position of the movable part 104 of the jack plate 100 in connection with measured vessel speed (all of which steps may be prompted or unprompted) until a predetermined or operator-selected vessel speed is reached. For example, after the operator further increases the vessel speed, in response to receiving a third store command, the controller 112 may store a measured third position of the movable part 104 of the jack plate 100 in connection with a measured third vessel speed. In one example, at least one of the second and third vessel speeds is a speed at which the marine vessel 140 is operating on-plane, such that the stored auto-jack profile includes vessel speeds through acceleration and getting up on-plane. Those having ordinary skill in the art will understand that the marine vessel 140 can be determined to be operating on-plane by the operator, who can sense when the vessel's position levels off on the water 180, by the vessel speed sensor 118 (if the controller 112 is programmed with the vessel manufacturer's estimated on-plane speed for the marine vessel 140), or by a sensor such as an accelerometer or an inclinometer. Optionally, the operator may increase vessel speed to a maximum vessel speed, as determined by the manufacturer of the marine vessel 140 and/or the power available from the marine propulsion device 160, and select to store a jack plate position at that maximum speed.

After a desired or pre-programmed number of sets of jack plate position and vessel speed have been stored in the memory 116, the controller 112 will exit the configure mode, as shown at 818. Optionally, the controller 112 will exit the configure mode automatically after determining that an on-plane speed, maximum speed, or other predetermined speed has been reached. Optionally, the operator may select to exit the configuration mode via an option or button available at one of the operator interfaces. The method would then return to 802.

Note that any of the above-noted prompts may be displayed via the touchscreen display 136 and/or another gauge. Additionally or alternatively, the prompts may be broadcast via a speaker. Note that the controller 112 may be configured such that the operator can select a type of configuration mode, such as a "self-configuration" mode, in which the operator is not prompted to increase vessel speed to predetermined speeds or enter "store" commands, or a "guided-configuration" mode, in which the operator is prompted to increase vessel speed to predetermined speeds and to enter "store" commands. The former may be desirable to more experienced operators, while the latter may be desirable to less experienced operators.

Figure 6:
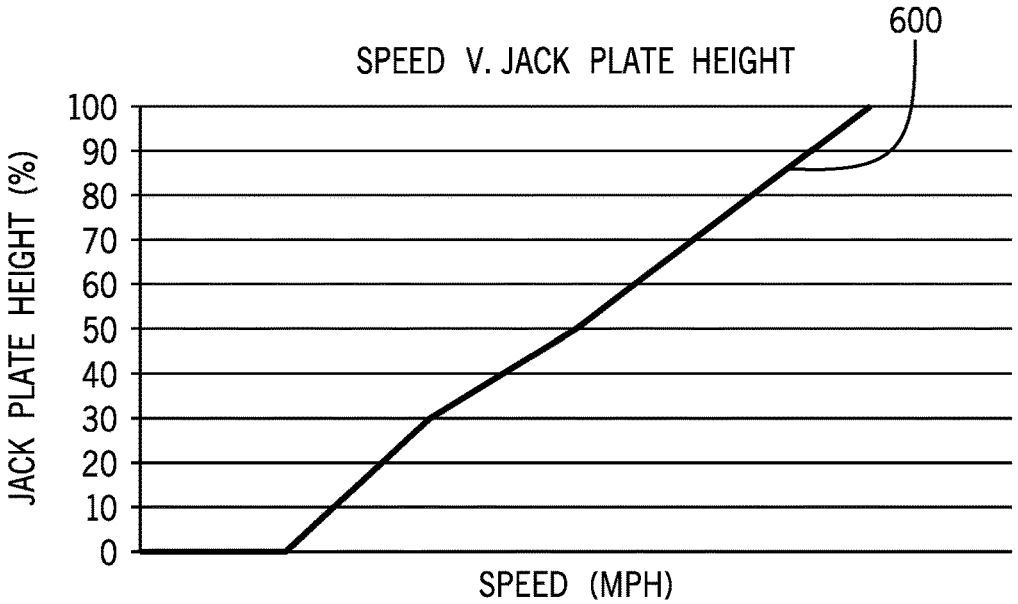
FIG. 6 is a chart showing an exemplary relationship between vessel speed and jack plate position.

Referring to FIG. 6, an exemplary auto-jack profile 600 stored by the controller 112 as a result of the above-noted process is shown. The profile 600 is shown as a relationship between vessel speed in miles per hour (MPH) and jack plate height in percentage of total allowable height (i.e., 0% being when piston rod 32 is fully retracted into hydraulic cylinder 30, and 100% being when piston rod 32 is fully extended from hydraulic cylinder 30). However, it should be understood that the relationship could be stored in other units. Additionally, the relationship is shown in the form of a chart in order to describe its trend more generally, but could instead be stored in the form of a look-up table. Alternatively, the relationship can be stored as an equation or series of equations that generalizes the stored relationship between jack plate positions and vessel speeds. It can be seen that generally, in the exemplary relationship of FIG. 6, jack plate position remains at 0% for lower vessel speeds, and gradually climbs at a rather steady slope towards 100% as vessel speed increases. Note that in other examples, jack plate height may not begin at 0% and may not end at 100%; rather, the operator can select the minimum and maximum jack plate positions based on how the marine vessel 140 handles at those positions at different vessel speeds.

Operators may also wish to have different stored relationships between vessel speed and jack plate position depending on how they intend to operate their vessel. For example, if the operator is using the marine vessel 140 for tow sports, during which there is relatively increased load on the boat, the operator may not want the marine vessel 140 to get up on-plane as quickly, and may therefore position the jack plate 100 differently than while operating in a non-towing mode. So too might an operator who is doing a high-speed run, during which the marine vessel 140 ideally gets up on-plane faster, want the jack plate to be positioned differently at different vessel speeds than while operating in a non-racing mode. Thus, the operator can enter/define or select from a predetermined list of operating modes at step 808, which would then be used to identify a particular vessel speed versus jack-plate position relationship stored in the memory 116. Additionally, the operator might wish to store a separate profile for jack plate position while the system 110 is also running in auto-trim mode versus when the operator is manually trimming the marine propulsion device 160, as the marine vessel 140 might behave differently in either instance. For example, the controller 112 may automatically control the marine propulsion device 160 coupled to the movable part 104 of the jack plate 100 to a vessel-speed-based trim position while in the configuration mode, and thus save speed-based jack plate positions that are optimal when operating in auto-trim.

The above-described auto-jack method optionally includes entering a configuration mode before receiving the first or second store command and exiting the configuration mode before controlling the automatic actuator assembly 106 to automatically position the movable part 104 of the jack plate 100 at the stored first or second position. The method also includes entering an automatic jack plate positioning mode before controlling the automatic actuator assembly 106 to automatically position the movable part 104 of the jack plate 100 at the stored first or second position in response to sensing that the marine vessel 140 is operating at or above the first or second vessel speed, respectively. Once the configuration mode is exited at 818 and any number of auto-jack profiles are stored, the controller 112 is able to run the auto-jack mode after such a selection is made at 804. At 806, if the auto-jack configuration mode is not selected, the method continues to 820, where, if the operator has programmed different profiles for jack plate position, the operator may then select which profile to use. The controller 112 may require that the vessel is operating at or below a predetermined vessel speed (which may be close to 0 MPH) before the auto-jack mode can be entered, in order to prevent unintended movement of the jack plate 100. Optionally, the controller 112 may automatically position the jack plate 100 at its lowest position (0% or another operator-stored minimum position) before proceeding, as shown at 822. Next, the operator may operate the marine vessel 140 in any manner desired. So long as the auto-jack mode remains on, in response to determining that the marine vessel 140 is operating at or above the above-noted first vessel speed (yes at 824), but below the second above-noted vessel speed (no at 826), the controller 112 will control the automatic actuator assembly 106 to automatically position the movable part 104 of the jack plate 100 at the stored first position, as shown at 828, according to the stored auto-jack profile.

The method then returns to 826 to determine if the second vessel speed is met or exceeded. If yes at 826, (and if a third vessel speed is not exceeded, as noted below) in response to determining that the marine vessel 140 is operating at or above the above-noted second vessel speed, the controller will control the automatic actuator assembly 106 to automatically position the movable part 104 of the jack plate 100 at the stored second position, according to the stored auto-jack profile.

However, if a third vessel speed and associated jack plate position have been stored, in response to determining that the marine vessel 140 is operating at or above the second vessel speed (yes at 826), but below the third vessel speed (no at 830), the controller 112 controls the automatic actuator assembly 106 to automatically position the movable part 104 of the jack plate 100 at the stored second position, as shown at 832. In response to determining that the marine vessel 140 is operating at or above the third vessel speed (yes at 830), the controller 112 controls the automatic actuator assembly 106 to automatically position the movable part 104 of the jack plate 100 at the stored third position, as shown at 834. Clearly, if fourth, fifth, etc. positions and speeds are stored in the jack-plate profile, the controller uses similar logic to position the jack plate at the stored position based on vessel speed.

Note that if a chart or look-up table is used to store the auto-jack profile, the controller 112 can determine a desired jack plate position at a vessel speed that was not specifically stored using interpolation between the data points that were specifically stored. This could provide more or less continuous movement of the jack plate as vessel speed increases. Alternatively, the jack plate 100 could be positioned incrementally, with the stored vessel speeds being discrete thresholds, and the jack plate position held in place until the next threshold is met or exceeded. Note that even if an equation is used to generalize the stored jack plate position and vessel speed relationship, there will still be "first," "second," "third," and so-on vessel speeds that must be met or exceeded in order to position the movable part 104 of the jack plate 100 at corresponding "first," "second," "third," and so-on positions.

As the vessel decreases in speed, the controller 112 may use the same profile that was stored while vessel speed increased to automatically position the jack plate 100. Optionally, instead of exiting auto-jack configuration mode after an on-plane, maximum, or other desired vessel speed is reached, the configuration mode may include prompting the operator (or otherwise allowing the operator to choose) to incrementally decrease vessel speed and store different jack plate positions while decreasing vessel speed until the vessel stops. It may be that an operator wants store and use a different deceleration profile to affect vessel positioning while coming off plane and stopping than while getting on plane and up to a desired speed. In this instance, the controller 112 may make an additional determination as to whether the marine vessel 140 is accelerating or decelerating, and may automatically select an acceleration or deceleration jack plate profile, as appropriate.

Optionally, the controller 112 may be programmed to stop automatically positioning the jack plate 100 (i.e., to maintain the current position of the movable part 104, as shown at 838) in response to determining that the marine vessel 140 is operating at or above a predetermined threshold vessel speed at 836. For example, the controller 112 will not control the automatic actuator assembly 106 to change the vertical position of the movable part 104 of the jack plate 100 unless a command from the operator interface is received, such as the "jack-up" input 134*a* or the "jack-down" input 134*b*. This prevents the marine vessel 140 from becoming unstable, as it requires specific operator input to move the jack plate 100 (and therefore presumably intended consequences thereof).

In fact, the operator may be able to override the auto-jack mode at any time using the "jack-up" input 134*a* or the "jack-down" input 134*b*. Selecting these inputs 134*a*, 134*b* may cause the auto-jack mode to be cancelled, after which the auto-jack "on/resume input" 134*c* would need to be selected before the jack plate 100 could again be automatically positioned based on vessel speed. The controller 112 may require that the vessel speed be below a threshold, which can be close to 0 MPH, before the auto-jack mode will resume. In other examples, the controller 112 can determine if the position of the jack plate 100 when the "on/resume" input 134*c* is selected is within a given deadband of the position the jack plate 100 should be at based on the current vessel speed. If yes, the auto-jack mode may be entered without first decreasing vessel speed below the threshold. If no, the controller 112 may prompt or otherwise require the operator to decrease vessel speed below the threshold before the auto-jack mode can be resumed.

Because the present system and method allow for operator programming of jack plate height versus speed, every marine vessel and marine propulsion device combination can have its own profile. This allows a specific profile to be stored that works best for the given application, rather than a one-size-fits-all profile. Optionally, a pre-programmed jack plate profile can be used during configuration mode, which the operator can tweak to the operator's preference while running the pre-programmed profile. The operator could save over the pre-programmed jack plate positions with operator-desired positions for use during future operation in the auto-jack mode.

It should be understood that although the present disclosure is of a system having one jack plate 100 coupling one marine propulsion device 160 to a marine vessel 140, similar methods could be used for multiple jack plates and multiple marine propulsion devices. It should also be understood that separate hydraulic systems need not be provided for each of the jack plate 100 and trim actuator 108, but that the same motor 42 and hydraulic pump 40 could be used to hydraulically power both devices' actuators, as shown in FIG. 5. Also note that if the systems were pneumatically or electrically actuated, the same pneumatic or electric actuator could be used both for the trim and jack plate systems as well. One motor and/or hydraulic or pneumatic source could be used for multiple marine propulsion devices' jack plates and trim systems, if desired.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A method for positioning a jack plate coupled to a transom of a marine vessel and having a part that is vertically movable with respect to the transom by way of an automatic actuator assembly, the method being carried out by a controller and comprising:

in response to receiving a first store command, storing a measured first position of the movable part of the jack plate in connection with a measured first vessel speed;

in response to receiving a second store command, storing a measured second position of the movable part of the jack plate in connection with a measured second vessel speed;

in response to determining that the marine vessel is operating at or above the first vessel speed, but below the second vessel speed, controlling the actuator assembly to automatically position the movable part of the jack plate at the stored first position;

in response to determining that the marine vessel is operating at or above the second vessel speed, controlling the actuator assembly to automatically position the movable part of the jack plate at the stored second position;

entering a configuration mode before receiving the first or second store command; and exiting the configuration mode before controlling the actuator assembly to automatically position the movable part of the jack plate at the stored first or second position.

2. The method of claim 1, further comprising:

while in the configuration mode, generating a first prompt for an operator to operate the marine vessel at the first vessel speed and to enter the first store command; and while in the configuration mode, generating a second prompt for the operator to operate the marine vessel at the second vessel speed and to enter the second store command.

3. The method of claim 1, further comprising generating a prompt for an operator to select or enter a profile name before or after entering the configuration mode.

4. The method of claim 1, further comprising entering an automatic jack plate positioning mode before or after entering the configuration mode.

5. The method of claim 1, further comprising automatically controlling a marine propulsion device coupled to the movable part of the jack plate to a vessel-speed-based trim position while in the configuration mode.

6. A method for positioning a jack plate coupled to a transom of a marine vessel and having a part that is vertically movable with respect to the transom by way of an automatic actuator assembly, the method being carried out by a controller and comprising:

in response to receiving a first store command, storing a measured first position of the movable part of the jack plate in connection with a measured first vessel speed;

in response to receiving a second store command, storing a measured second position of the movable part of the jack plate in connection with a measured second vessel speed;

in response to determining that the marine vessel is operating at or above the first vessel speed, but below the second vessel speed, controlling the actuator assembly to automatically position the movable part of the jack plate at the stored first position;

in response to determining that the marine vessel is operating at or above the second vessel speed, controlling the actuator assembly to automatically position the movable part of the jack plate at the stored second position;

in response to receiving a third store command, storing a measured third position of the movable part of the jack plate in connection with a measured third vessel speed;

in response to determining that the marine vessel is operating at or above the second vessel speed, but below the third vessel speed, controlling the actuator assembly to automatically position the movable part of the jack plate at the stored second position; and in response to determining that the marine vessel is operating at or above the third vessel speed, controlling the actuator assembly to automatically position the movable part of the jack plate at the stored third position.

7. The method of claim 6, wherein at least one of the second and third vessel speeds is a speed at which the marine vessel is operating on-plane.

8. The method of claim 1, further comprising:

receiving the measured first and second positions of the movable part of the jack plate from a jack plate position sensor; and receiving the measured first and second vessel speeds from a vessel speed sensor.

9. A method for positioning a jack plate coupled to a transom of a marine vessel and having a part that is vertically movable with respect to the transom by way of an automatic actuator assembly, the method being carried out by a controller and comprising:

in response to receiving a first store command, storing a measured first position of the movable part of the jack plate in connection with a measured first vessel speed;

in response to receiving a second store command, storing a measured second position of the movable part of the jack plate in connection with a measured second vessel speed;

in response to determining that the marine vessel is operating at or above the first vessel speed, but below the second vessel speed, controlling the actuator assembly to automatically position the movable part of the jack plate at the stored first position;

in response to determining that the marine vessel is operating at or above the second vessel speed, controlling the actuator assembly to automatically position the movable part of the jack plate at the stored second position; and entering an automatic jack plate positioning mode before controlling the actuator assembly to automatically position the movable part of the jack plate at the stored first or second position in response to sensing that the marine vessel is operating at or above the first or second vessel speed, respectively.

10. A system for positioning a jack plate coupled to a transom of a marine vessel, the system comprising:

an automatic actuator assembly configured to move a movable part of the jack plate vertically with respect to the transom;

a jack plate position sensor configured to measure a position of the movable part of the jack plate;

a vessel speed sensor configured to measure a speed of the marine vessel; and a controller in signal communication with the jack plate position sensor, the vessel speed sensor, and the actuator assembly;

wherein in response to receiving a first store command, the controller stores a measured first position of the movable part of the jack plate in connection with a measured first vessel speed;

wherein in response to receiving a second store command, the controller stores a measured second position of the movable part of the jack plate in connection with a measured second vessel speed;

wherein in response to determining that the marine vessel is operating at or above the first vessel speed, but below the second vessel speed, the controller controls the actuator assembly to automatically position the movable part of the jack plate at the stored first position;

wherein in response to determining that the marine vessel is operating at or above the second vessel speed, the controller controls the actuator assembly to automatically position the movable part of the jack plate at the stored second position;

wherein the controller enters a configuration mode before receiving the first or second store command; and wherein the controller exits the configuration mode before controlling the actuator assembly to automatically position the movable part of the jack plate at the stored first or second position.

11. The system of claim 10, further comprising an operator interface in signal communication with the controller;

wherein while in the configuration mode, the controller generates a first prompt via the operator interface for an operator to operate the marine vessel at the first vessel speed and to enter the first store command; and wherein while in the configuration mode, the controller generates a second prompt via the operator interface for the operator to operate the marine vessel at the second vessel speed and to enter the second store command.

12. The system of claim 10, further comprising an operator interface in signal communication with the controller;

wherein the controller generates a prompt via the operator interface for an operator to select or enter a profile name before or after entering the configuration mode.

13. The system of claim 10, wherein the controller enters an automatic jack plate positioning mode before or after entering the configuration mode.

14. The system of claim 10, further comprising a marine propulsion device coupled to the movable part of the jack plate;

wherein the controller commands an automatic trim system to position the marine propulsion device to a vessel-speed-based trim position while in the configuration mode.

15. A system for positioning a jack plate coupled to a transom of a marine vessel, the system comprising:

an automatic actuator assembly configured to move a movable part of the jack plate vertically with respect to the transom;

a jack plate position sensor configured to measure a position of the movable part of the jack plate;

a vessel speed sensor configured to measure a speed of the marine vessel; and a controller in signal communication with the jack plate position sensor, the vessel speed sensor, and the actuator assembly;

wherein in response to receiving a first store command, the controller stores a measured first position of the movable part of the jack plate in connection with a measured first vessel speed;

wherein in response to receiving a second store command, the controller stores a measured second position of the movable part of the jack plate in connection with a measured second vessel speed;

wherein in response to determining that the marine vessel is operating at or above the first vessel speed, but below the second vessel speed, the controller controls the actuator assembly to automatically position the movable part of the jack plate at the stored first position;

wherein in response to determining that the marine vessel is operating at or above the second vessel speed, the controller controls the actuator assembly to automatically position the movable part of the jack plate at the stored second position;

wherein in response to receiving a third store command, the controller stores a measured third position of the jack plate in connection with a measured third vessel speed;

wherein in response to determining that the marine vessel is operating at or above the second vessel speed, but below the third vessel speed, the controller controls the actuator assembly to automatically position the movable part of the jack plate at the stored second position; and wherein in response to determining that the marine vessel is operating at or above the third vessel speed, the controller controls the actuator assembly to automatically position the movable part of the jack plate at the stored third position.

16. The system of claim 15, wherein at least one of the second and third vessel speeds is a speed at which the marine vessel is operating on-plane.

17. The system of claim 10, wherein the controller enters an automatic jack plate positioning mode before controlling the actuator assembly to automatically position the movable part of the jack plate at the stored first or second position in response to sensing that the marine vessel is operating at or above the first or second vessel speed, respectively.

18. A system for positioning a jack plate coupled to a transom of a marine vessel, the system comprising:

an automatic actuator assembly configured to move a movable part of the jack plate vertically with respect to the transom;

a jack plate position sensor configured to measure a position of the movable part of the jack plate;

a vessel speed sensor configured to measure a speed of the marine vessel; and a controller in signal communication with the jack plate position sensor, the vessel speed sensor, and the actuator assembly;

wherein in response to receiving a first store command, the controller stores a measured first position of the movable part of the jack plate in connection with a measured first vessel speed;

wherein in response to receiving a second store command, the controller stores a measured second position of the movable part of the jack plate in connection with a measured second vessel speed;

wherein in response to determining that the marine vessel is operating at or above the first vessel speed, but below the second vessel speed, the controller controls the actuator assembly to automatically position the movable part of the jack plate at the stored first position;

wherein in response to determining that the marine vessel is operating at or above the second vessel speed, the controller controls the actuator assembly to automatically position the movable part of the jack plate at the stored second position;

wherein the system further comprises an operator interface configured to allow an operator to input a command to change a vertical position of the movable part of the jack plate; and wherein, in response to determining that the marine vessel is operating at or above a predetermined threshold vessel speed, the controller does not control the actuator assembly to change the vertical position of the movable part of the jack plate unless the command from the operator interface is received.

* * * * *